US009095740B2

(12) United States Patent
Wu

(10) Patent No.: US 9,095,740 B2
(45) Date of Patent: Aug. 4, 2015

(54) TILTING AND FOLDING DEVICE FOR A TREADMILL

(71) Applicant: STRENGTH MASTER FITNESS TECH CO., LTD., Taichung (TW)

(72) Inventor: Shu-Yao Wu, Taichung (TW)

(73) Assignee: Strength Master Fitness Tech Co., Ltd., Taichung (TW)

( * ) Notice: Subject to any disclaimer, the term of this patent is extended or adjusted under 35 U.S.C. 154(b) by 160 days.

(21) Appl. No.: 13/756,881

(22) Filed: Feb. 1, 2013

(65) Prior Publication Data

US 2014/0221167 A1 Aug. 7, 2014

(51) Int. Cl.
*A63B 22/02* (2006.01)
*A63B 22/00* (2006.01)

(52) U.S. Cl.
CPC ..... *A63B 22/0235* (2013.01); *A63B 22/0023* (2013.01); *A63B 2210/50* (2013.01)

(58) Field of Classification Search
CPC . A63B 22/02; A63B 2210/56; A63B 22/0235
USPC ..... 482/54
See application file for complete search history.

(56) References Cited

U.S. PATENT DOCUMENTS

| | | | | |
|---|---|---|---|---|
| 6,872,169 | B2 * | 3/2005 | Kuo | 482/54 |
| 7,081,069 | B2 * | 7/2006 | Hsu | 482/54 |
| 7,166,065 | B2 * | 1/2007 | Chang | 482/54 |
| 7,413,529 | B2 * | 8/2008 | Lee et al. | 482/54 |
| 8,734,303 | B2 * | 5/2014 | Huang et al. | 482/54 |
| 2001/0049323 | A1 * | 12/2001 | Fox | 482/54 |
| 2004/0204296 | A1 * | 10/2004 | Maenpaa et al. | 482/54 |
| 2005/0159273 | A1 * | 7/2005 | Chen | 482/54 |
| 2005/0164840 | A1 * | 7/2005 | Chen | 482/54 |
| 2013/0237384 | A1 * | 9/2013 | Huang et al. | 482/54 |
| 2014/0121066 | A1 * | 5/2014 | Huang et al. | 482/54 |
| 2014/0121067 | A1 * | 5/2014 | Huang et al. | 482/54 |
| 2014/0221167 | A1 * | 8/2014 | Wu | 482/54 |

* cited by examiner

*Primary Examiner* — Stephen Crow
(74) *Attorney, Agent, or Firm* — Rosenberg, Klein & Lee

(57) ABSTRACT

A tilting and folding device of a treadmill includes a base and a track bed is pivotably connected to the base by an arm, a support device and an actuator. The arm is pivotably connected between the base and the track bed. The actuator is pivotably connected between the base and a pivotal portion located between the first and second pivotal ends. The support device is pivotably connected to the base and the track bed. When the arm is pivoted about the second pivotal end and driven by the actuator, the front end of the track bed is lifted and stopped after being traveled to a pre-set stroke. When the actuator continuously drives the arm, the rear end of the track bed is supported by the support device and pivoted until the track bed is located upright.

11 Claims, 15 Drawing Sheets

TILTING AND FOLDING DEVICE FOR A TREADMILL

FIELD OF THE INVENTION

The present invention relates to a treadmill, and more particularly, to a tilting and folding device for a treadmill.

BACKGROUND OF THE INVENTION

The conventional treadmill is a commonly used interior exerciser and generally comprises folding device which allows the users to fold the treadmill for convenience of storage and transportation.

U.S. Pat. No. 5,855,537 discloses a powered folding treadmill apparatus and method, and comprises a track bed 10 with two support legs 12, 14 on two sides of the track bed 10. Each of the two support legs 12, 14 has an inclined motor 36/38 located therein so as to drive the correspondent linear actuator 44 to extend and retract. When the linear actuator is activated, the front end of the track bed can be controlled to be lifted or lowered. When the linear actuator is lowered, which pivots an arm 48, and the rear end of the track bed is lifted to an upright position by the engagement of the male and female spline structures 54, 58.

The lifting of the track bed is made by the inclined motor, the linear actuator and the arm of each of the two support legs. When the front end of the track bed is lifted, the arm is lifted by the linear actuator which is driven by the inclined motor. When the track bed is to be folded, the rear end of the track bed is lifted, the arm is lowered by the linear actuator which is driven by the inclined motor, and the male and female spline structures 54, 58 are engaged with each other. It is noted that the lifting action of the front end of the track bed and the lifting action of the rear end of the track bed are made by two individual actions. The two individual actions require precisely arrangement of the related parts and the high cost is incurred.

Furthermore, in order to ensure that the front end or the rear end of the track bed can be precisely lifted, the two sides of the track bed should be simultaneously lifted or lowered. However, the two actions are made by two individual inclined motors, when the two inclined motors are not controlled to be operated simultaneously due to the design of the electric circuits, the transmission between the inclined motors and the linear actuators, between the inclined motors and the arms or between the male and female spline structures has a time lag, the two sides of the track bed cannot move simultaneously. The design and the assembling processes have to be precise enough to achieve the purposes. The large number of parts in the inclined motors, the linear actuators and the arms also make the cost be high and have less competition in the market.

The present invention intends to provide a tilting and folding device for a treadmill to improve the shortcomings of the conventional folding devices.

SUMMARY OF THE INVENTION

The present invention relates to a tilting and folding treadmill and comprises a base a track bed which has a front end and a rear end. The rear end of the track bed is put on a floor. An arm has first pivotal end pivotably connected to the track bed, and a second pivotal end pivotably connected to the base. A pivotal portion is located between the first pivotal end and the second pivotal end. An actuator is pivotably connected between the base and the pivotal portion. A support device is pivotably connected to the base and the track bed. When the arm is pivoted about the second pivotal end and driven by the actuator, the front end of the track bed is lifted and stopped after being traveled to a pre-set stroke. When the actuator continuously drives the arm, the rear end of the track bed is supported by the support device and continuously lifted to an upright position.

The primary object of the present invention is to provide a tilting and folding device of a treadmill and the folding device uses only one actuator and one arm to lift the track bed to the upright position so as to improve the shortcomings of the conventional folding device.

The present invention will become more obvious from the following description when taken in connection with the accompanying drawings which show, for purposes of illustration only, a preferred embodiment in accordance with the present invention.

DETAILED DESCRIPTION OF THE PREFERRED EMBODIMENT

Figure 1:
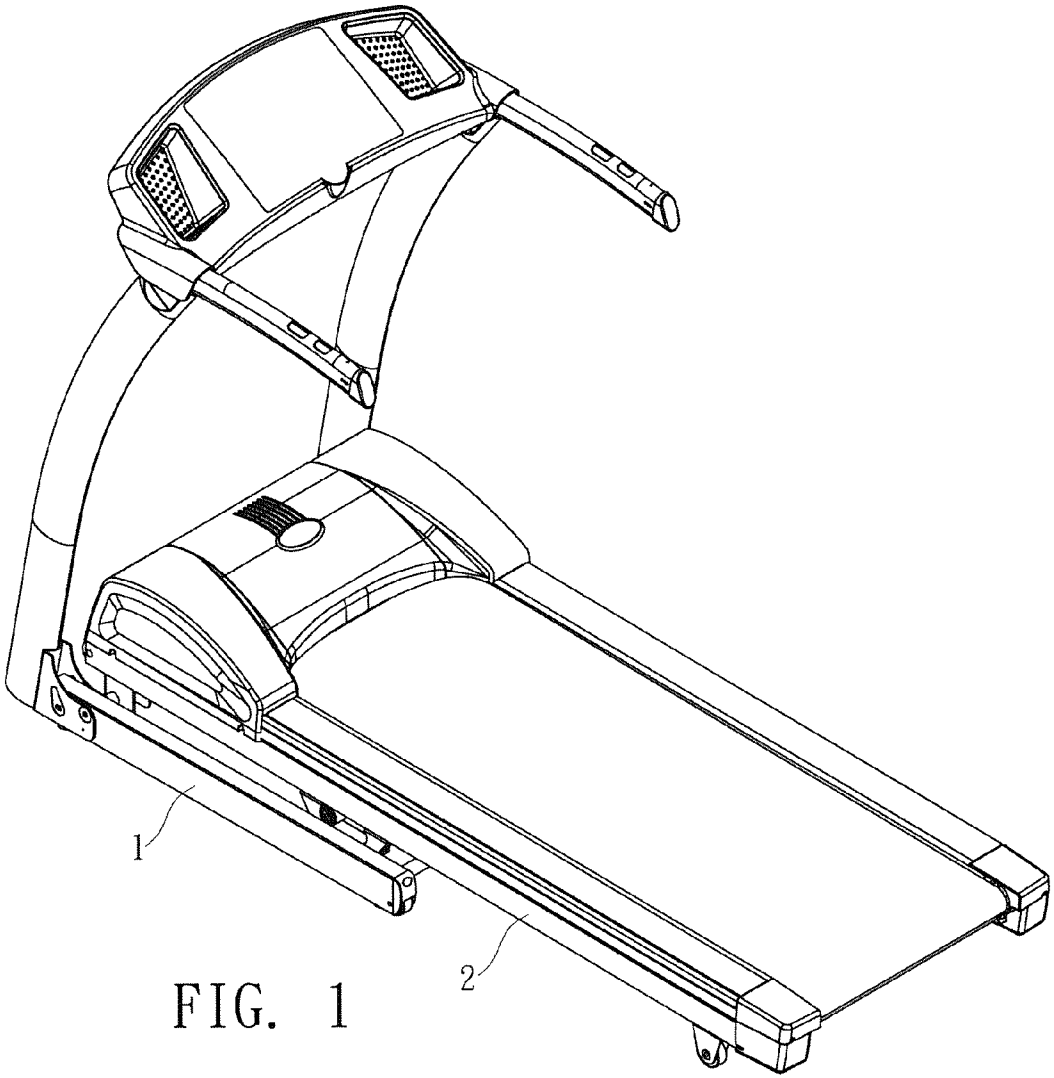
FIG. 1 is a perspective view to show the tilting and folding device of a treadmill of the present invention.
Figure 2:
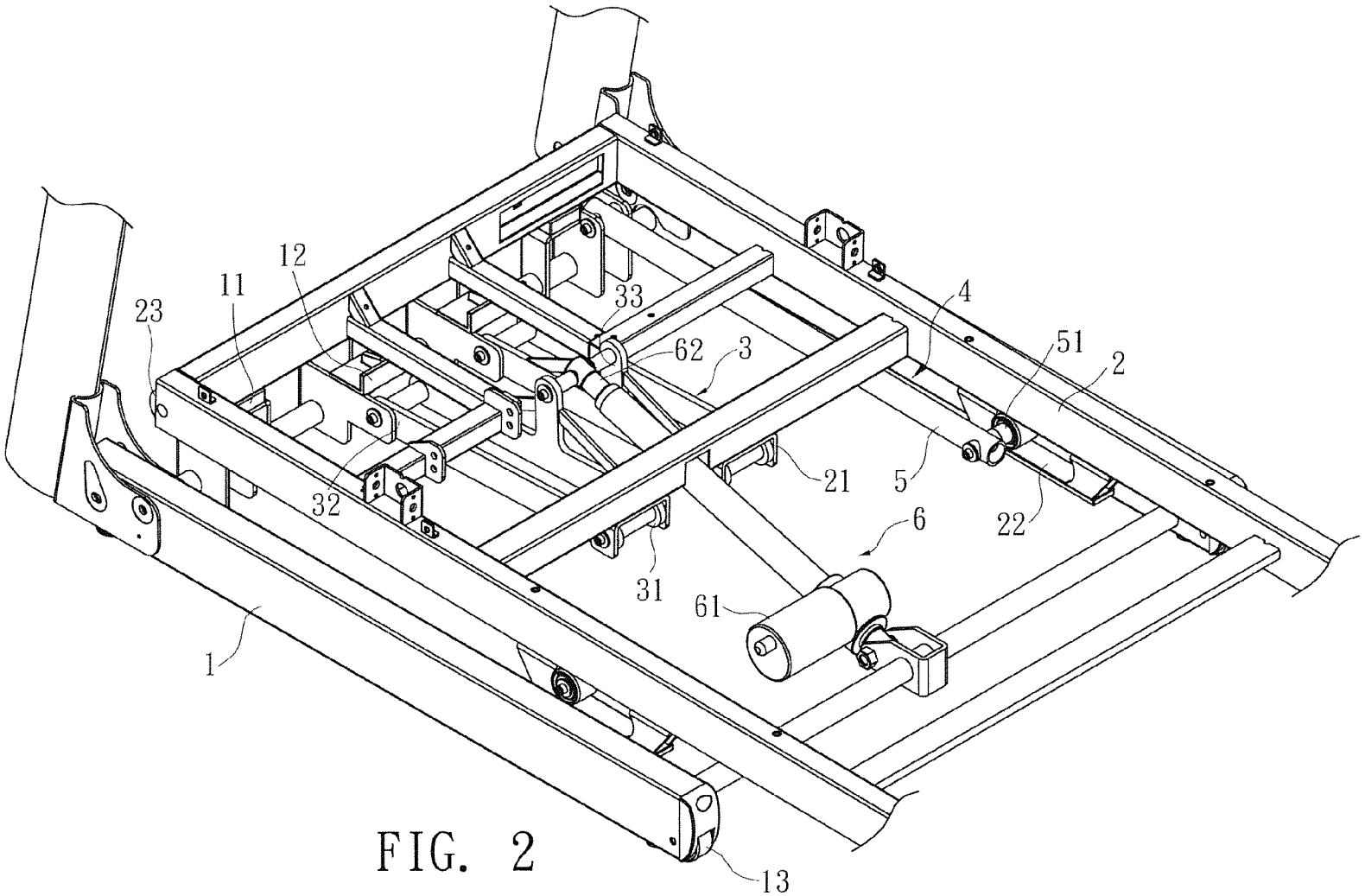
FIG. 2 is a perspective view to show the main parts of the tilting and folding device of a treadmill of the present invention.
Figure 3:
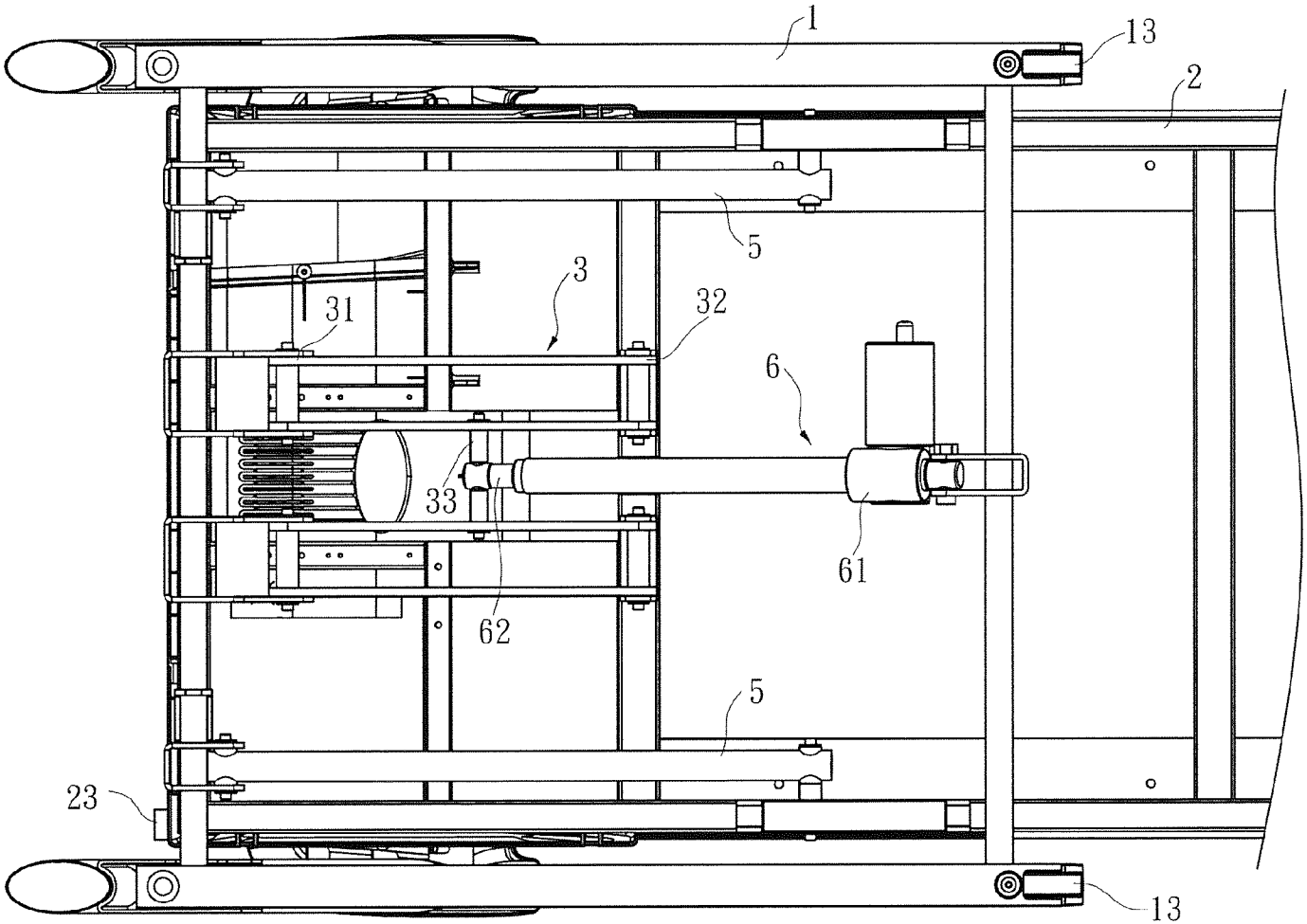
FIG. 3 is a top view to show the tilting and folding device of a treadmill of the present invention.

Referring to FIGS. 1 to 3, the tilting and folding device of a treadmill of the present invention comprises a base 1 and a track bed 2 is located on the base 1 and has a front end and a rear end which is put on the floor. The base 1 has two wheels 13 connected to the underside of the two sides thereof so that the base 1 can be moved easily. The front end of the track bed 2 has a wheel 23 connected thereto which contacts the floor when the track bed 2 is folded.

An arm 3, a support device 4 and an actuator 6 are connected between the base 1 and the track bed 2.

The arm 3 has a first pivotal end 31 and a second pivotal end 32, wherein the first pivotal end 31 is pivotably connected to the track bed 2 and the second pivotal end 32 is pivotably connected to the base 1. A pivotal portion 33 is located between the first pivotal end 31 and the second pivotal end 32. In detail, the track bed 2 has a connection portion 21 transversely connected between the two sides of the track bed 2. The first pivotal end 31 of the arm 3 is pivotably connected to the connection portion 21.

The support device 4 is pivotably connected to the base 1 and the track bed 2, and comprises two link 5 and two slots 22 which are respectively defined in two insides of the track bed 2. The links 5 each have a first end are pivotably connected to the base 1 and a second end of each link 5 has a protrusion 51 extending radially thereform, the protrusion 51 is slidably engaged with the slot 22 corresponding thereto. The two respective protrusions 51 are slidably engaged with the slots 22 and each slot 22 has a pre-set stroke.

The actuator 6 comprises a motor 61 on the first end thereof, and a threaded rod 62 is retractably connected to the second end of the actuator 6. The first end of the actuator 6 is pivotably connected to a bar transversely connected between the two sides of the base 1, and the threaded rod 62 is pivotably connected to the pivotal portion 33 of the arm 3. The bar to which the first end of the actuator 6 is connected is located away from the front end of the track bed 2. The pivotal portion 33 is located higher than the bar to which the first end of the actuator 6 is connected, so that the threaded rod 62 can pivot the arm 3 upward when the threaded rod 62 is extended.

Figure 4:
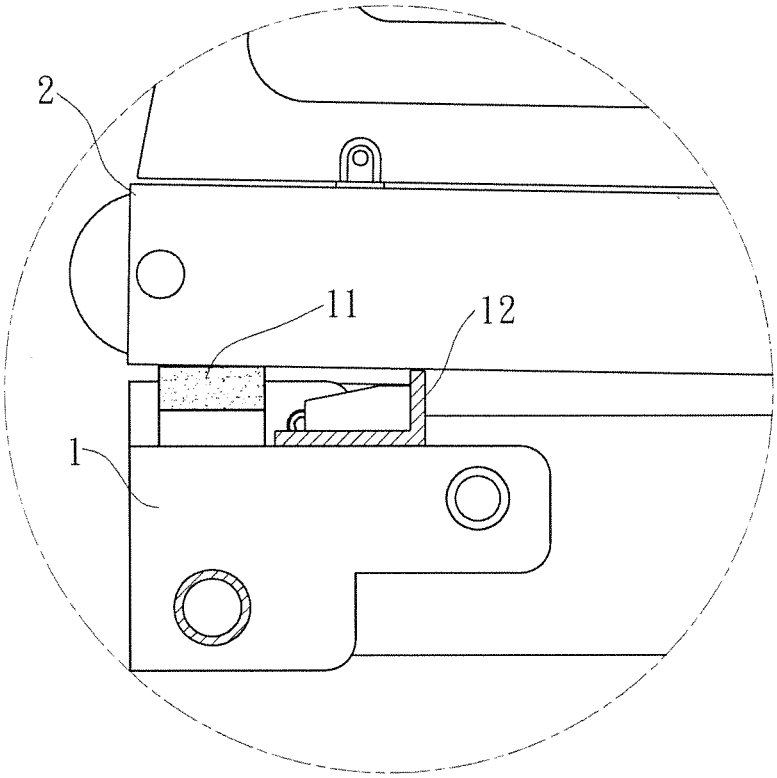
FIG. 4 shows that the track bed is supported on the buffering device on the base of the tilting and folding device of a treadmill of the present invention.
Figure 5:
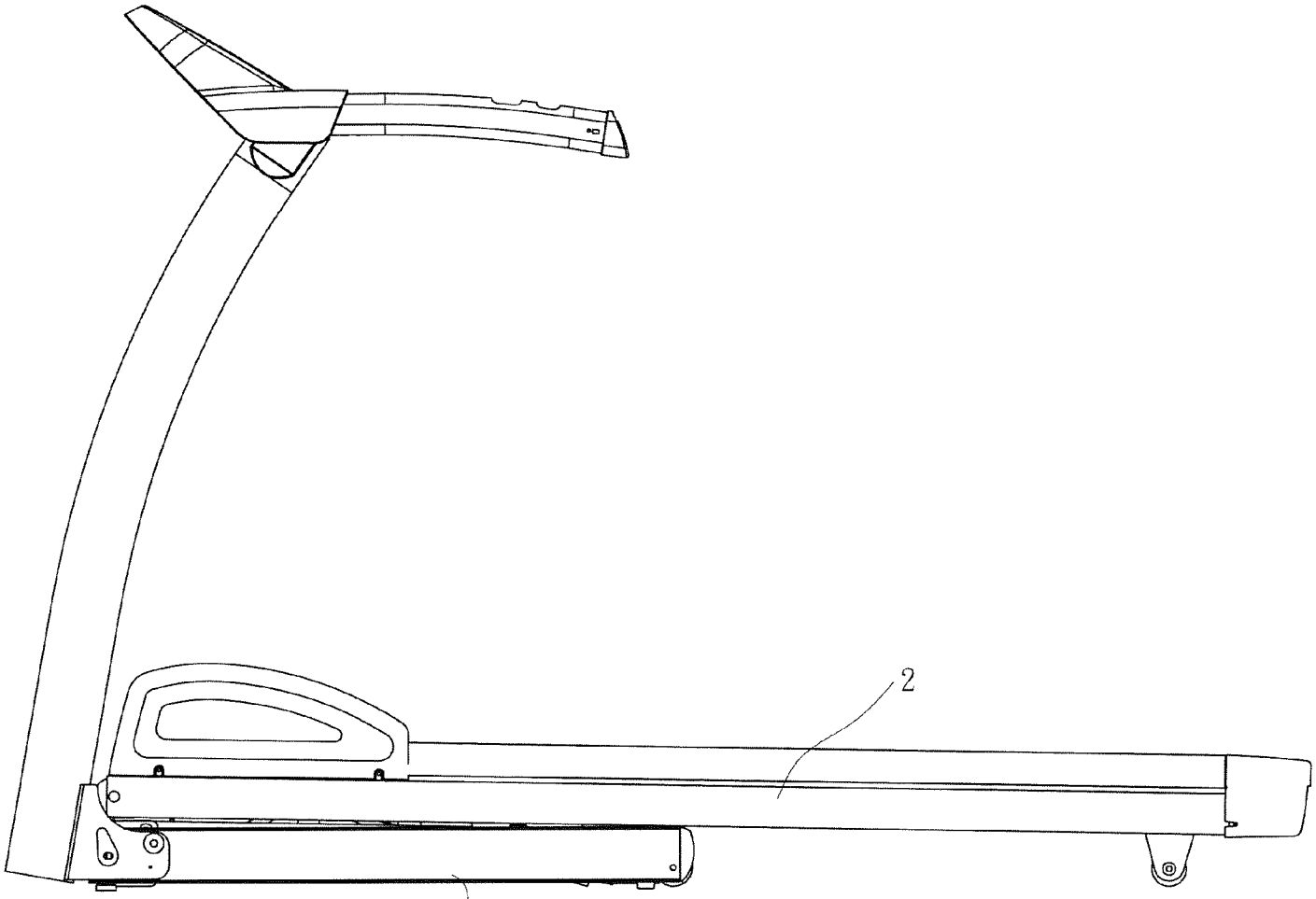
FIG. 5 is a side view to show that the track bed is in horizontal position relative to the base of the tilting and folding device of a treadmill of the present invention.

There are two buffering devices 11 connected to the underside of the front end of the track bed 2, in this embodiment, the buffering devices 11 are resilient pads. The resilient pads are connected to the underside of the track bed 2 so as to absorb the load applied to the base 1 as shown in FIGS. 4 and 5.

Figure 6:
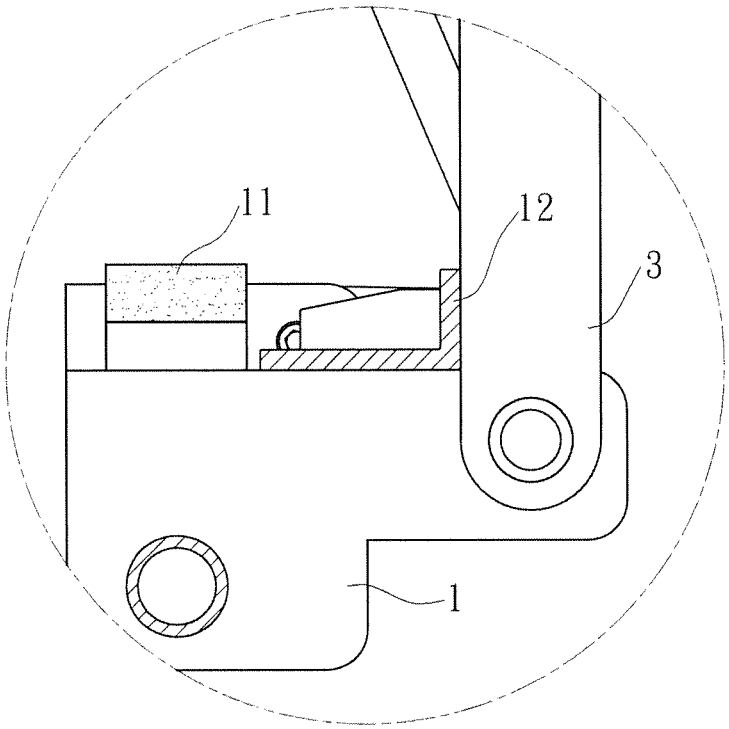
FIG. 6 shows that the arm is stopped by the stop on the base.

As shown in FIG. 6, the base 1 has two stops 12 extending therefrom and the arm 3 is stopped by the stops 12 when the arm 3 reaches the upright position.

Figure 7:
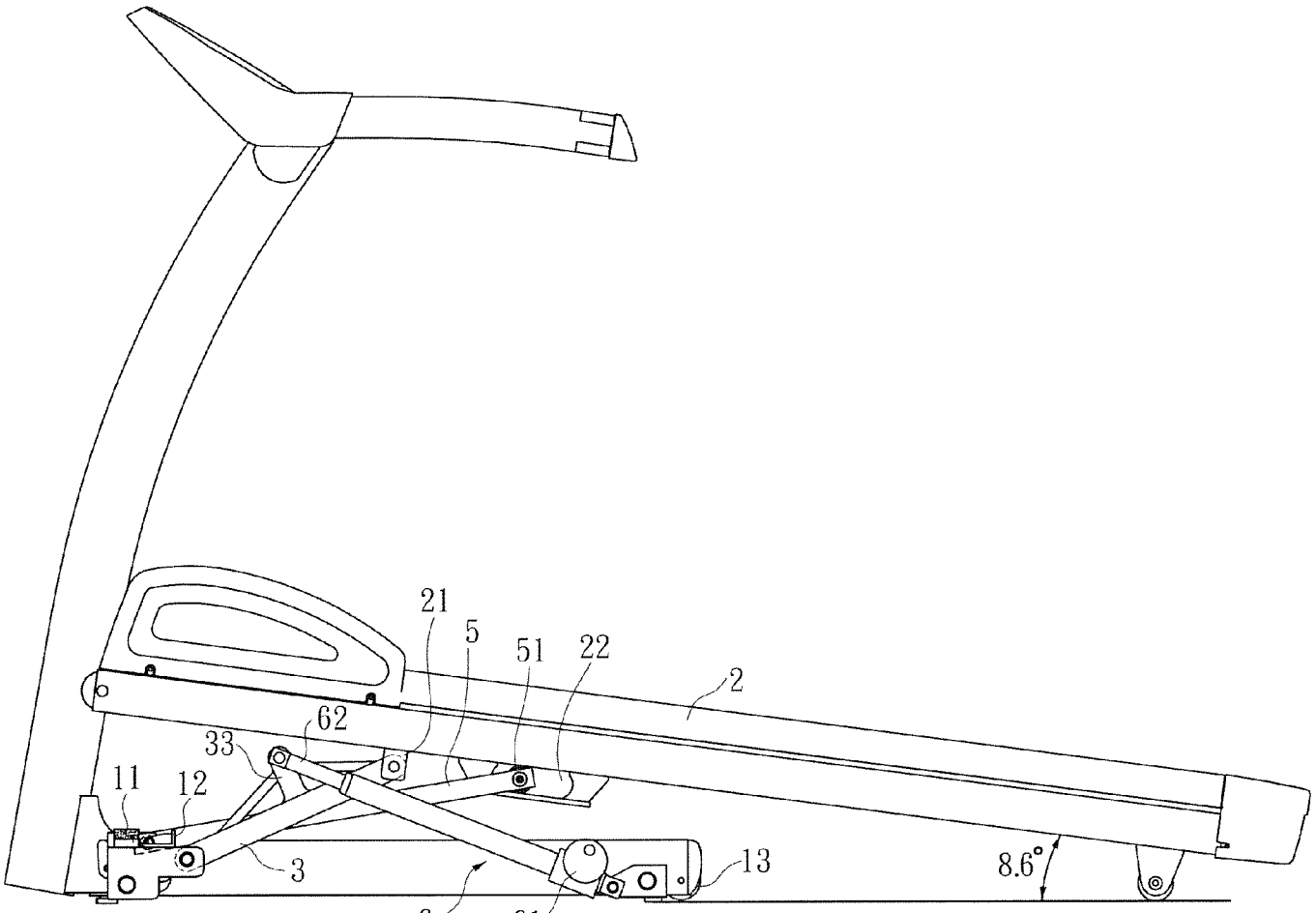
FIG. 7 shows that the front end of the track bed is lifted.
Figure 8:
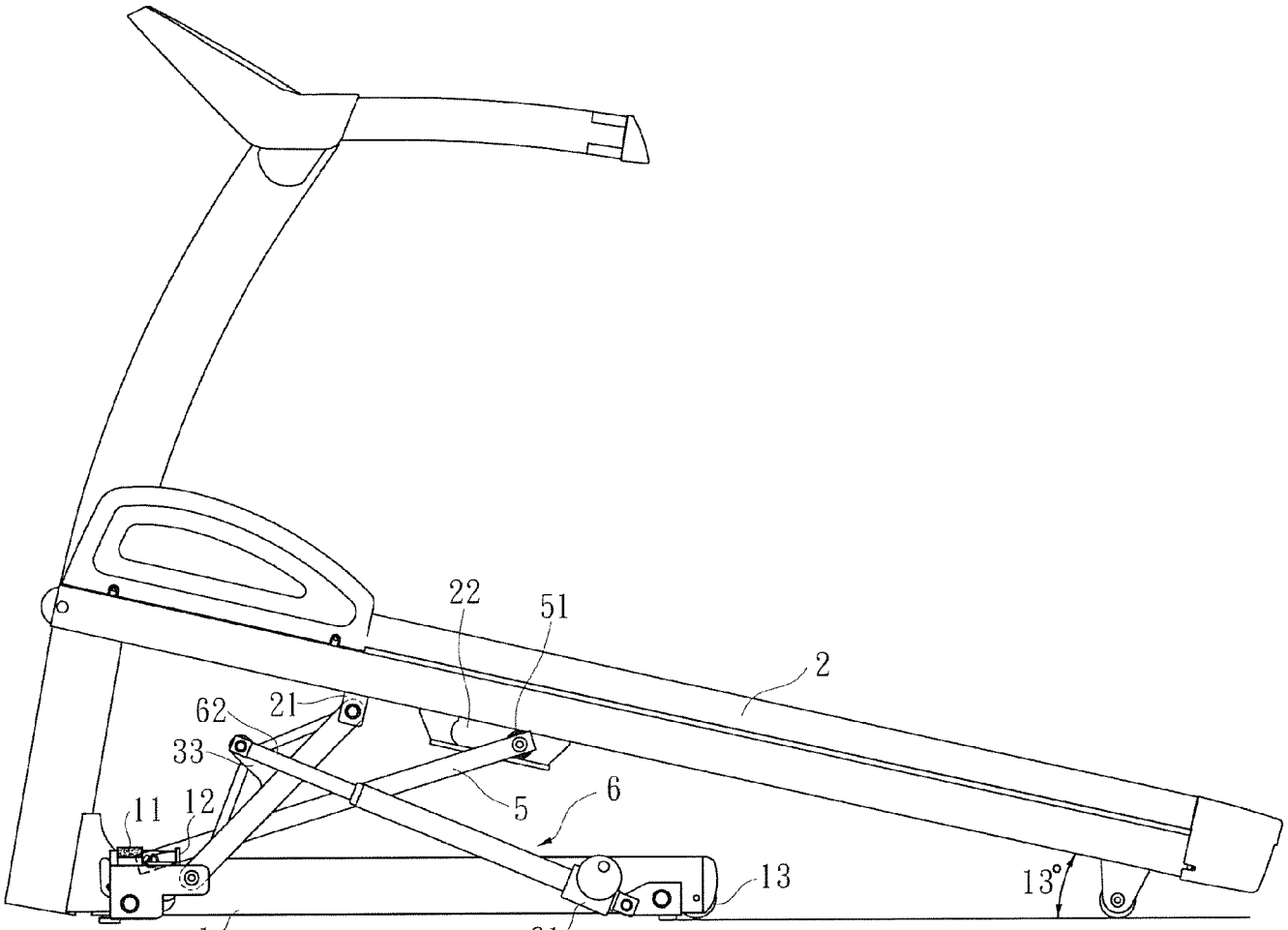
FIG. 8 shows that the protrusion of the link moves the end of the slot.
Figure 9:
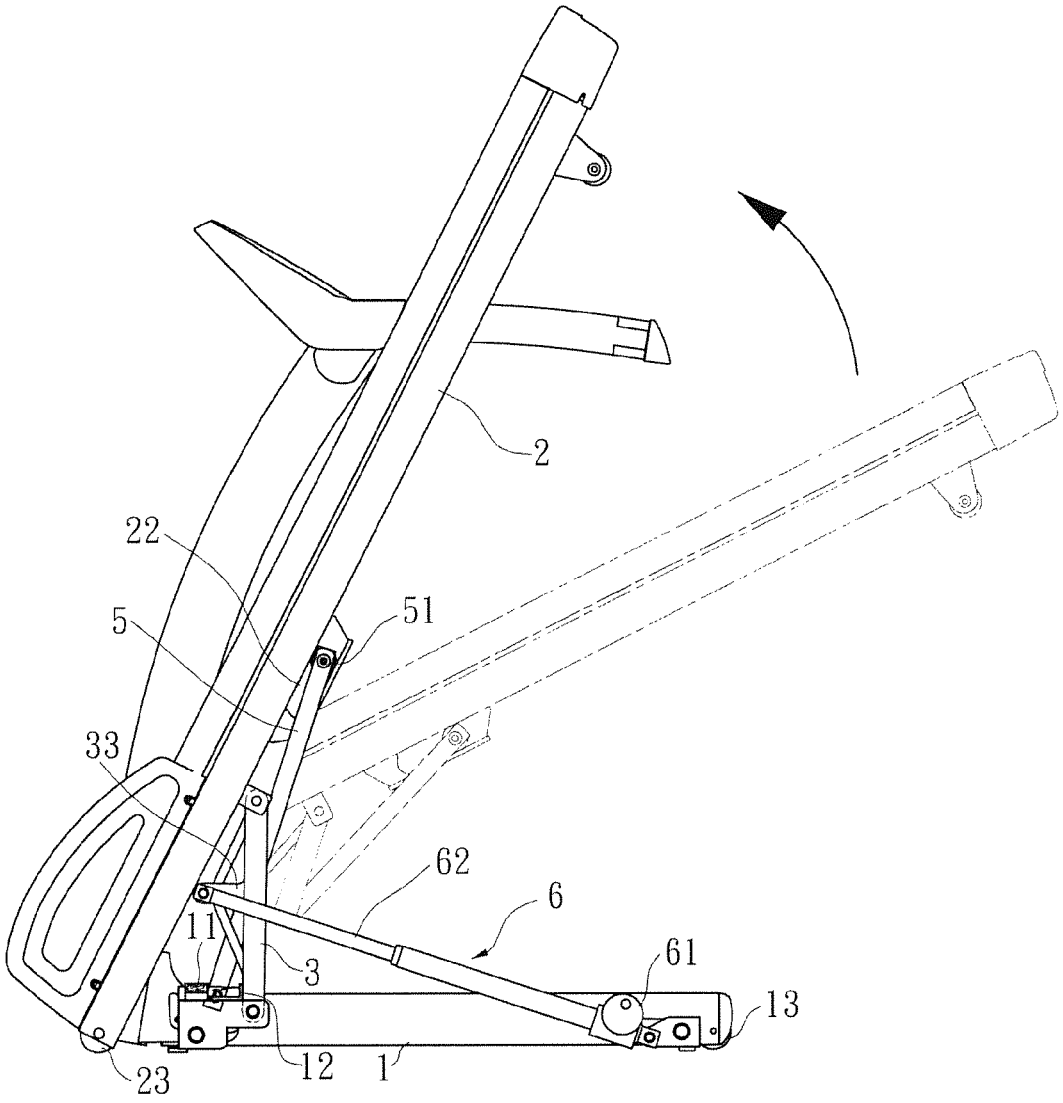
FIG. 9 shows that the rear end of the track bed is pivoted to the upright position.

As shown In FIG. 7, when the front end of the track bed 2 is to be lifted, the motor 61 is activated to extend the threaded rod 62 so that the arm 3 is pivoted about the second pivotal end 32 to lift the front end of the track bed 2. The angle that the front end of the track bed 2 lifts is about 8.6 degrees. When the track bed 2 is to be positioned at the upright position, the motor 61 continuously extend the threaded rod 62 as shown in FIG. 8 and the protrusion 51 on the second end of each link 5 moves to one end of the travel stroke in the slot 22. The links 5 support the track bed 2 and the angle that the front end of the track bed 2 is about 13 degrees. The base 1, the track bed 2, the arm 3 and the links 5 form a 4-bar linkage. As shown in FIG. 9, along with the extension of the threaded rod 62, the rear end of the track bed 2 is lifted and until the stops 12 stop the arm 3 to maintain the track bed 2 at the upright position.

The front end of the track bed 2 can be lifted to a pre-set position and will not be lifted further, the rear end of the track bed 2 then is lifted along with the continuous extension of the threaded rod 62 of the actuator 6, so that the arm 3 is continuously pivoted to lift the rear end of the track bed 2. During the action, the support device 4 supports the track bed 2 and the track bed 2 can be pivoted to its upright position.

The pivotal movement of the track bed 2 is made by the pivotal movement of the arm 3 which is driven by the threaded rod 62. In other words, the threaded rod 62 moves in one direction to pivot the track bed 2 from the horizontal position to the upright position. Compared with the two individual actions of the conventional folding device, the folding action of the present invention is more simplified and the actions of the related parts are also simplified so that the cost of fabrication is reduced.

Because the front end and the rear end of the track bed 2 are lifted and lowered by the arm 3 which is driven by the single actuator 6, so that the two sides of the track bed 2 are ensured to move simultaneously. This allows the treadmill not to be manufactured precisely and to use less number of parts.

Figure 10:
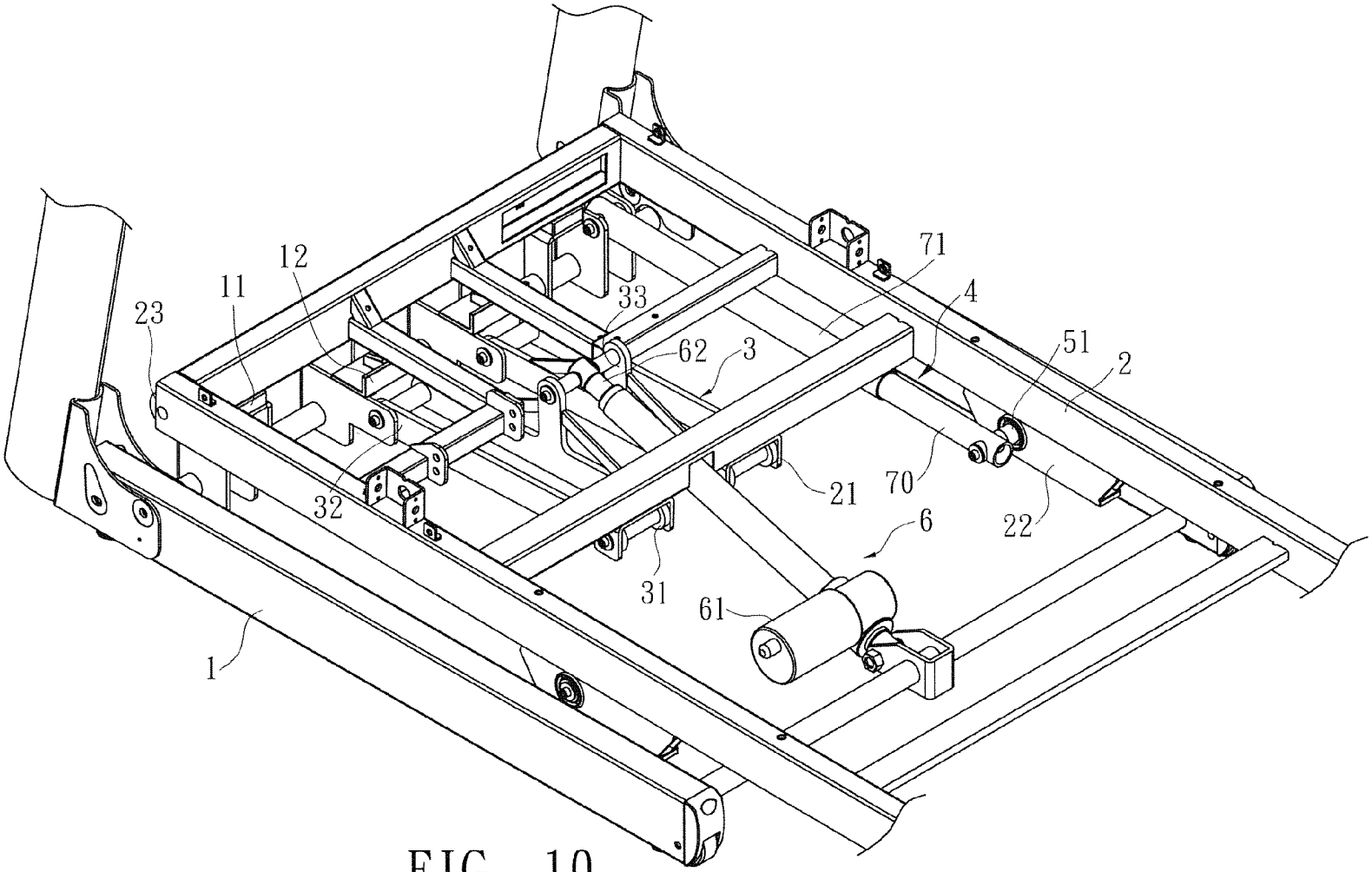
FIG. 10 shows the main parts of the second embodiment of the tilting and folding device of a treadmill the present invention.

FIG. 10 shows the second embodiment of the present invention, wherein the support device 4 replaces the two links 5 as disclosed in the previous embodiment by two retractable units 7. The two retractable units 7 are located to the two insides of the track bed 2 and each comprises an inner tube 70 and an outer tube 71 in which the inner tube 70 is retractably inserted. A biasing unit, such as a compressed air or spring (not shown) is located in the outer tube 71 so as to normally push the inner tube 70 out from the outer tube 71. The outer tube 71 has one end pivotably connected to the base 1 and the inner tube 70 extends beyond the connection portion 21 and is pivotably connected to the inside of the track bed 2.

Figure 11:
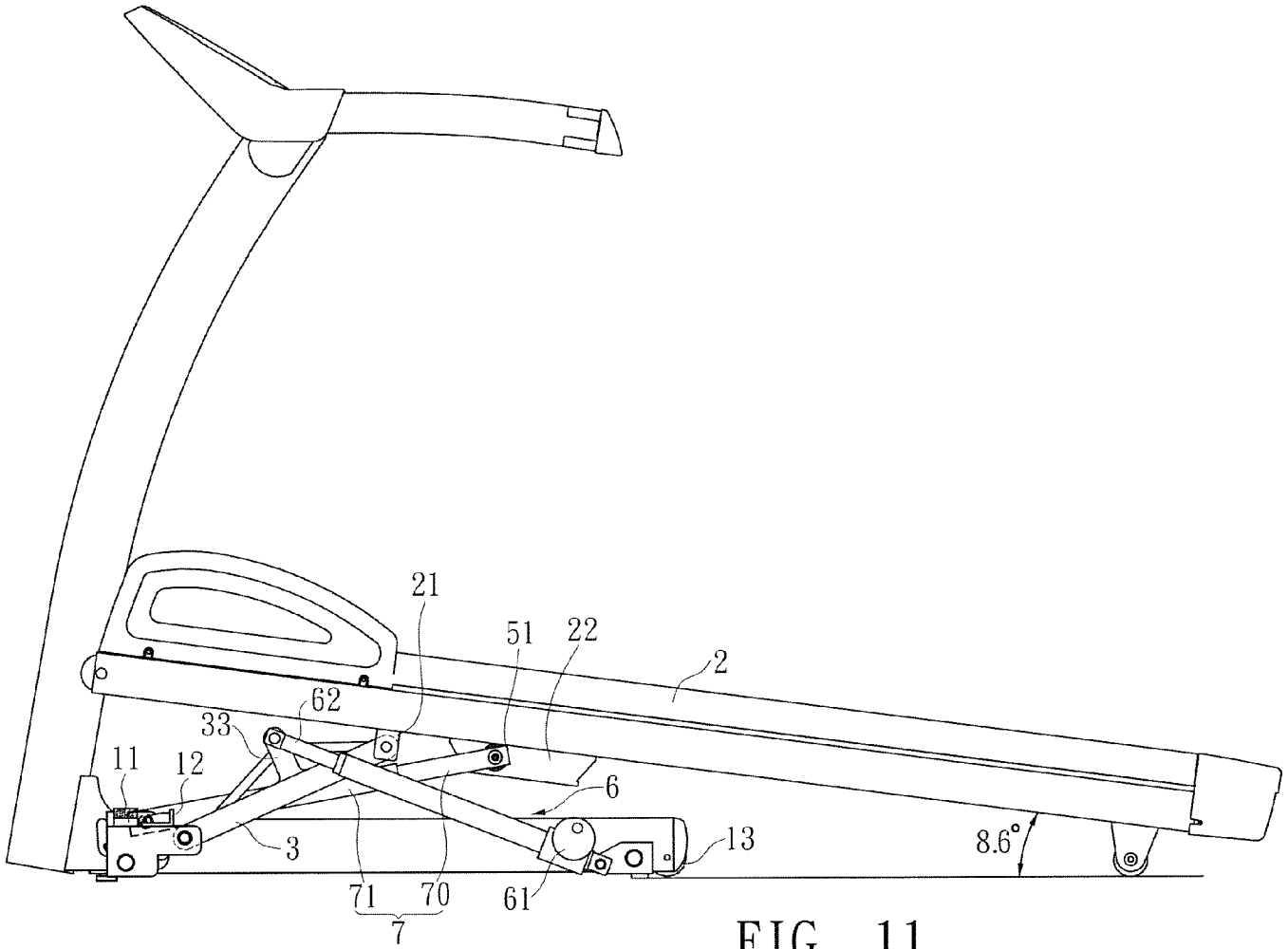
FIG. 11 shows that the front end of the track bed is lifted of the second embodiment of the tilting and folding device of a treadmill the present invention.
Figure 12:
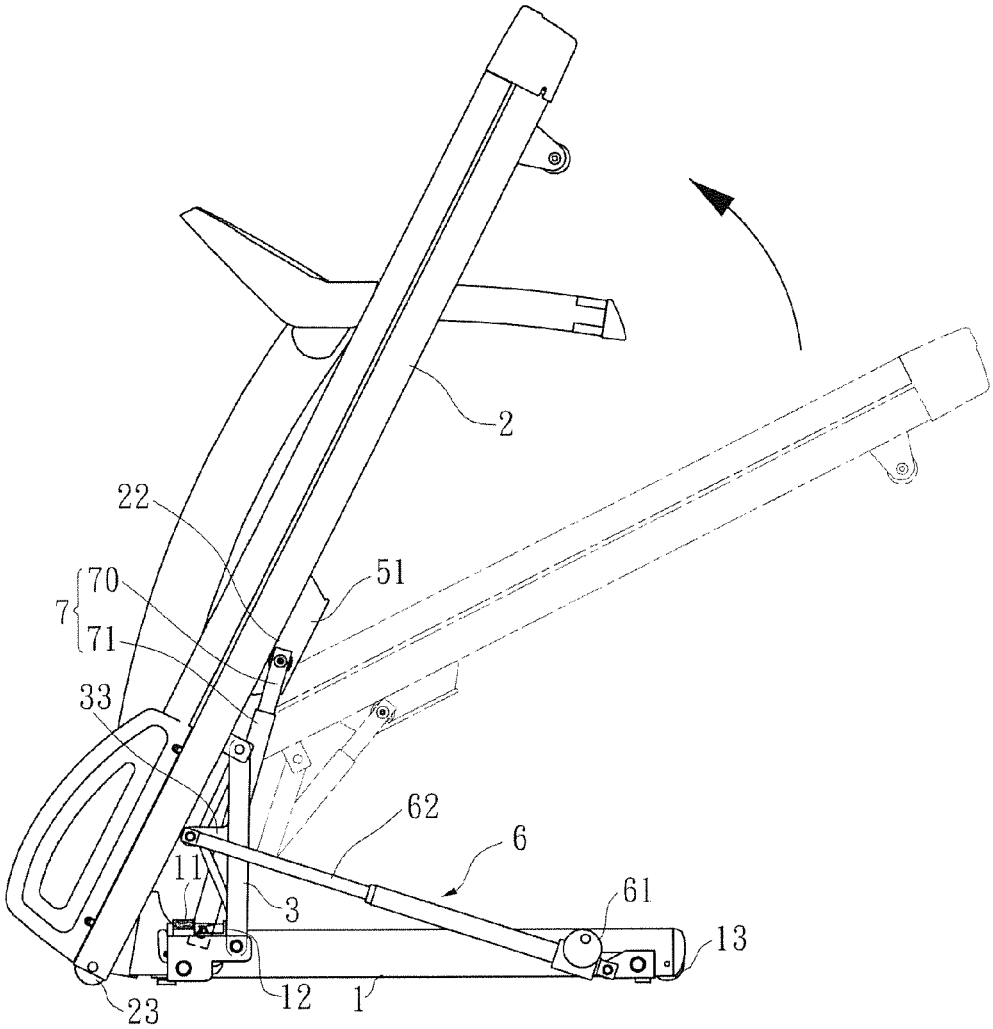
FIG. 12 shows that the rear end of the track bed of the second embodiment of the tilting and folding device of a treadmill of the present invention is pivoted to the upright position.

As shown in FIG. 11, when the threaded rod 62 extends, the arm 3 pivots the front end of the track bed 2. As shown in FIG. 12, when the threaded rod 62 extends, the inner tube 70 extends and supports the track bed 2, when the threaded rod 62 continuously extends, the rear end of the track bed 2 is lifted to the upright position.

Figure 13:
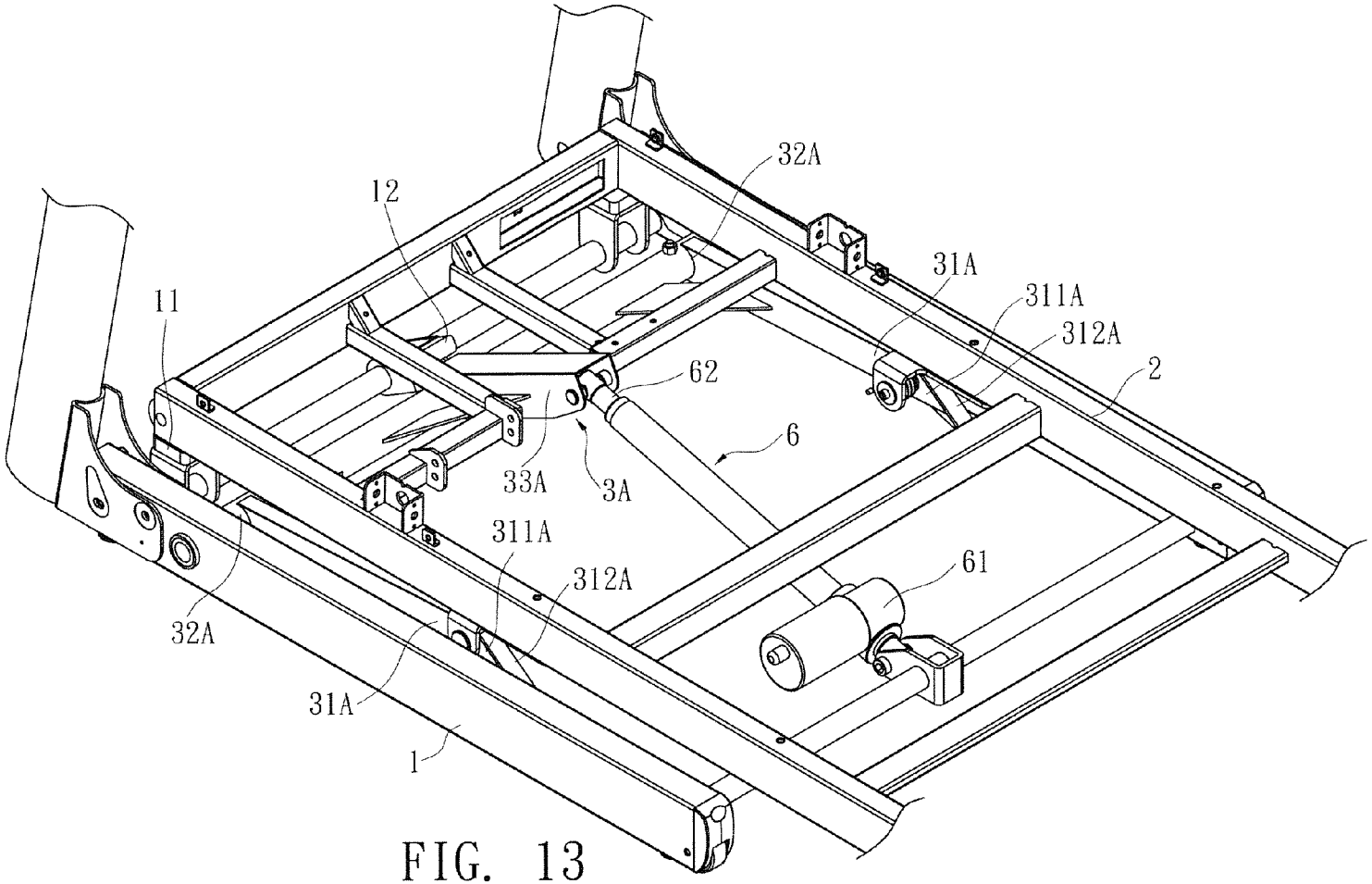
FIG. 13 shows the main parts of the third embodiment of the tilting and folding device of a treadmill of the present invention.

FIG. 13 shows the third embodiment, wherein the arm 3A has a first pivotal end 31A, a second pivotal end 32A and a pivotal portion 33A. The support device 4 comprises a support portion 311A fixed to the first pivotal end 31. The support portion 311A is moved with the arm 3 and has a contact face 312A. The arm 3A is pivotably connected to the two sides of the track bed 2 at the support portion 311A. The contact face 312A supports the underside of the track bed 2. The pre-set stroke starts from the track bed 2 at the horizontal position to the position where the contact face 312A supports the underside of the track bed 2.

Figure 14:
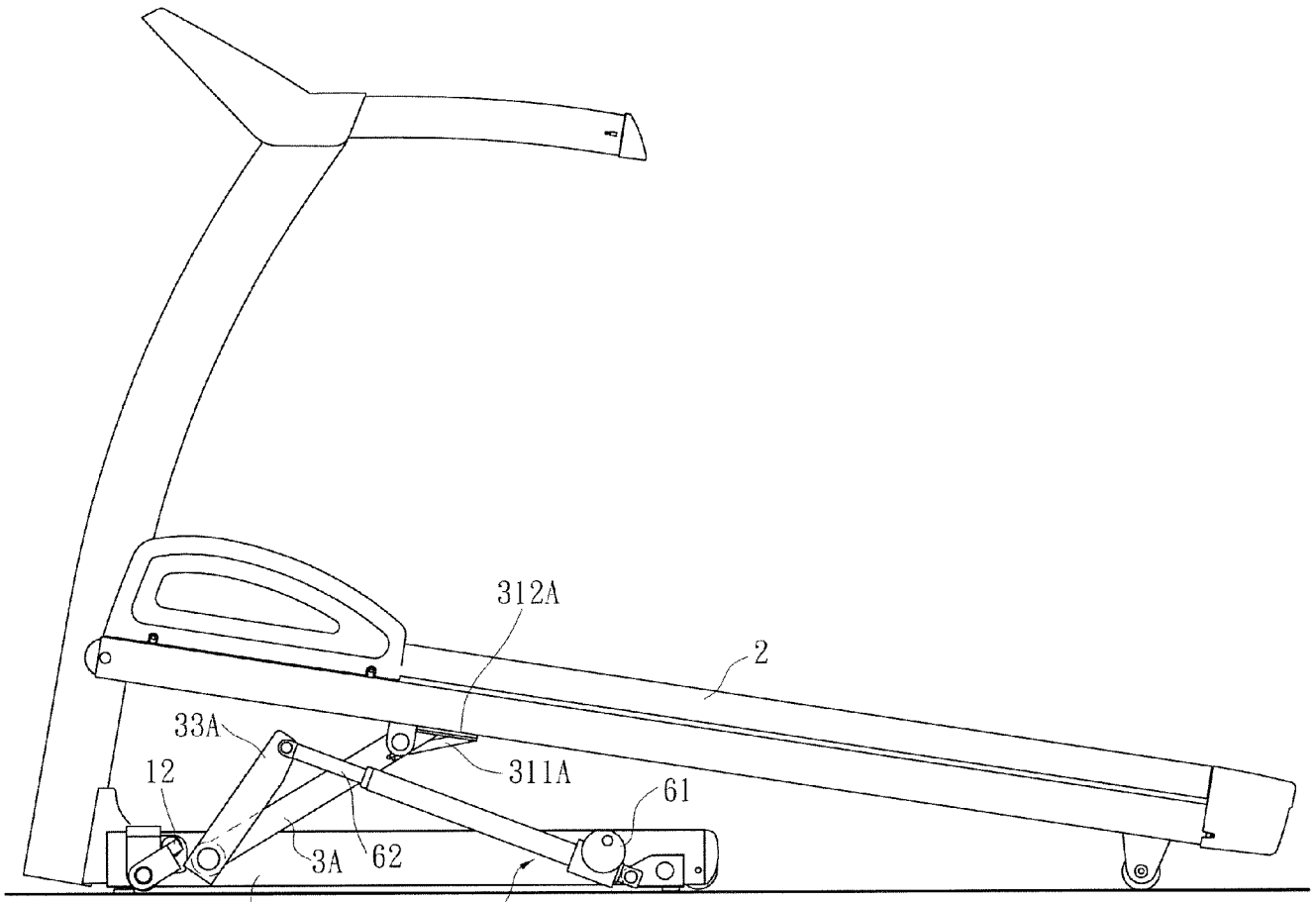
FIG. 14 shows that the front end of the track bed is lifted of the third embodiment of the tilting and folding device of a treadmill of the present invention.
Figure 15:
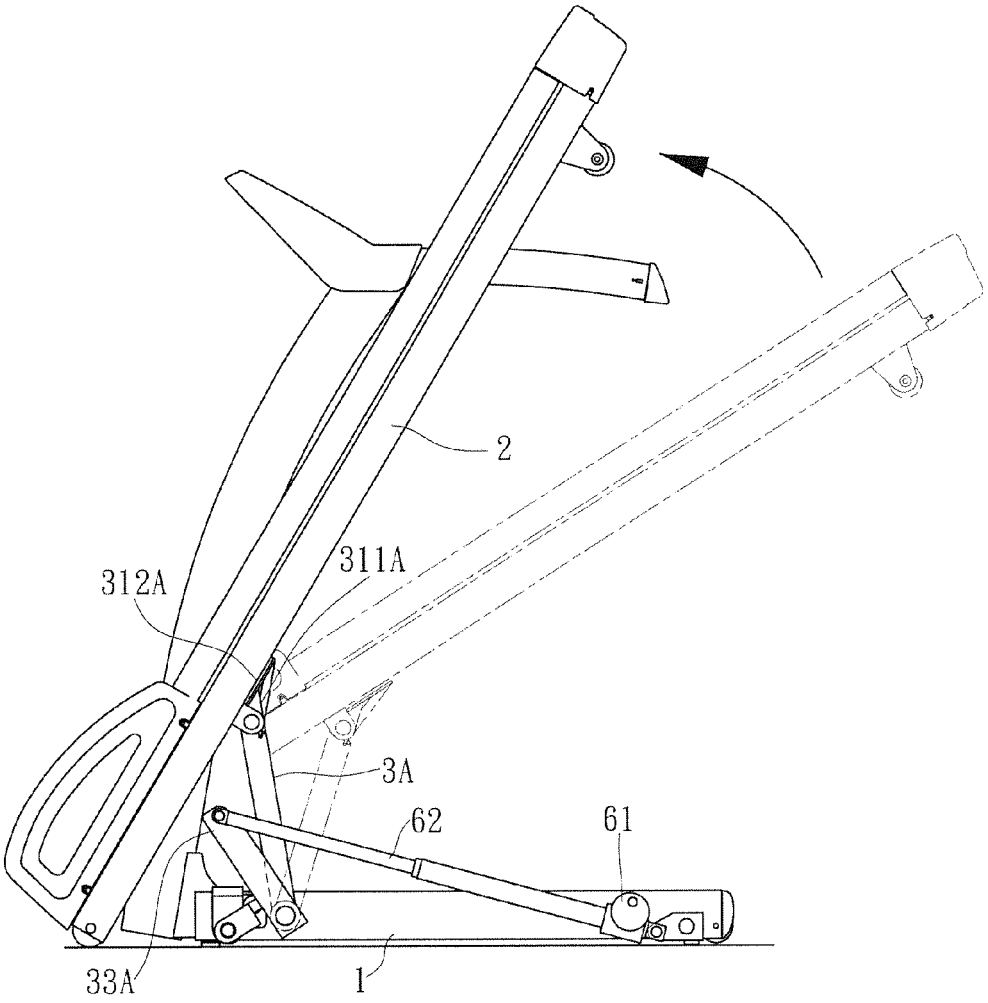
FIG. 15 shows that the rear end of the track bed of the third embodiment of the tilting and folding device of a treadmill of the present invention is pivoted to the upright position.

As shown in FIG. 14, the threaded rod 62 extends to pivot the arm 3A upward and the front end of the track bed 2 is lifted. When the track bed 2 is lifted to a height, the support portion 311A supports the track bed 2. As shown In FIG. 15, when the threaded rod 62 continuously extends, because the track bed 2 is supported by the support portion 311A, the rear end of the track bed 2 is pivoted upward until the upright position.

While we have shown and described the embodiment in accordance with the present invention, it should be clear to those skilled in the art that further embodiments may be made without departing from the scope of the present invention.

What is claimed is:

1. A tilting and folding device of a treadmill, comprising:

a base;

a track bed having a front end and a rear end, said front end and said rear end being independently liftable;

an arm having a first pivotal end pivotably connected to the track bed, and a second pivotal end pivotably connected to a front end of the base, a pivotal portion located between the first pivotal end and the second pivotal end;

an actuator having an end pivotably connected to the base and a second end of the actuator pivotably connected to the pivotal portion, the second end of the actuator being extendable through a defined stroke, the front end of the track bed being lifted by the arm driven by the actuator and pivoted about the second pivotal end responsive to the second end of the actuator extending to a first stroke of the defined stroke; and a support device pivotably coupled between the base and the track bed, the rear end of the track bed being lifted and supported to an upright position responsive to the second end of the actuator extending from the first stroke to a second stroke of the defined stroke.

2. The tilting and folding device of a treadmill as claimed in claim 1, wherein the support device comprises a link and a slot, the slot is defined in the track bed, the link has a first end is pivotably connected to the base and a second end of link is slidably engaged with the slot.

3. The tilting and folding device of a treadmill as claimed in claim 2, wherein the track bed has a connection portion to which the first pivotal end of the arm is pivotably connected, the slot has the pre-set stroke and the second end of the link is movable in the pre-set stroke which controls an angle that the front end of the track bed is lifted, when the second end of the link moves to an end of the pre-set stroke, the rear end of the track bed is lifted and pivoted to the upright position by the actuator.

4. The tilting and folding device of a treadmill as claimed in claim 1, wherein the base has a stop extending therefrom and the arm is stopped by the stop to restrict the range of the arm.

5. The tilting and folding device of a treadmill as claimed in claim 1, wherein a buffering device is located between the front end of the track bed and the base.

6. The tilting and folding device of a treadmill as claimed in claim 1, wherein the front end of the track bed has a wheel connected thereto which is adapted to contact the floor when the track bed is folded.

7. The tilting and folding device of a treadmill as claimed in claim 1, wherein the base has another wheel connected thereto.

8. The tilting and folding device of a treadmill as claimed in claim 1, wherein the support device comprises a retractable unit pivotably connected to the base and the track bed.

9. The tilting and folding device of a treadmill as claimed in claim 8, wherein the retractable unit comprises an inner tube and an outer tube in which the inner tube is retractably inserted so as to provide the pre-set stroke which controls an angle that the front end of the track bed is lifted.

10. The tilting and folding device of a treadmill as claimed in claim 1, wherein the support device comprises a support portion fixed to the first pivotal end, the support portion is moved with the arm and has a contact face.

11. The tilting and folding device of a treadmill as claimed in claim 10, wherein the pre-set stroke starts from the track bed at a horizontal position to a position where the contact face supports an underside of the track bed.

* * * * *